US009199707B1

(12) United States Patent
Smallin et al.

(10) Patent No.: US 9,199,707 B1
(45) Date of Patent: Dec. 1, 2015

(54) CABLE CUTTING SYSTEM FOR RETRIEVAL OF EXERCISE MINES AND OTHER UNDERWATER PAYLOADS

(71) Applicants: Bryan J. Smallin, Panama City, FL (US); James L. Bacot, Jr., Panama City Beach, FL (US)

(72) Inventors: Bryan J. Smallin, Panama City, FL (US); James L. Bacot, Jr., Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 104 days.

(21) Appl. No.: 13/975,521

(22) Filed: Aug. 26, 2013

(51) Int. Cl.
*F42B 22/00* (2006.01)
*B63G 7/00* (2006.01)

(52) U.S. Cl.
CPC .. *B63G 7/00* (2013.01); *F42B 22/00* (2013.01)

(58) Field of Classification Search
USPC ..... 89/1.13, 1.14, 1.11, 1.1; 102/401, 402, 102/406, 411; 83/613, 639.1; 114/221 A
See application file for complete search history.

(56) References Cited

U.S. PATENT DOCUMENTS 2,892,401 A * 6/1959 Michelson ..... 102/414
3,838,642 A * 10/1974 Shimberg ..... 102/404
3,844,244 A * 10/1974 White ..... 114/221 A
3,858,166 A * 12/1974 Hammond ..... 367/133
3,886,842 A * 6/1975 Giebel et al. ..... 89/1.14
4,123,974 A * 11/1978 Mutsch et al. ..... 102/411
4,128,071 A * 12/1978 Layman et al. ..... 114/221 A
4,136,415 A * 1/1979 Blockburger ..... 441/2
4,141,295 A * 2/1979 Campbell et al. ..... 102/407
4,158,322 A * 6/1979 Hardesty ..... 89/1.14
4,221,166 A * 9/1980 Bjork et al. ..... 102/411
4,230,040 A * 10/1980 Bjork et al. ..... 102/411
4,262,379 A * 4/1981 Jankiewicz ..... 441/2
4,274,333 A * 6/1981 Lampton ..... 102/418
4,463,496 A * 8/1984 Reich et al. ..... 30/180
4,495,849 A * 1/1985 Cooke et al. ..... 89/1.14
4,512,411 A * 4/1985 Pringle ..... 166/54.5
4,839,873 A * 6/1989 Cochrane et al. ..... 367/133
4,970,936 A * 11/1990 Denker et al. ..... 89/1.14
4,972,776 A * 11/1990 Shumaker et al. ..... 102/402
5,016,535 A * 5/1991 Hallstrom ..... 102/411
5,033,354 A * 7/1991 Talkington ..... 89/1.1
5,042,387 A * 8/1991 Backstein ..... 102/402
5,219,245 A * 6/1993 Chin-Yee ..... 405/191
5,411,225 A * 5/1995 Lannon et al. ..... 244/137.1
5,703,315 A * 12/1997 Coggan ..... 89/1.14
5,771,833 A * 6/1998 Hasse ..... 114/221 A
6,261,142 B1 * 7/2001 Fiotakis ..... 441/11
6,928,765 B2 * 8/2005 Brickett ..... 43/1
7,534,152 B1 * 5/2009 Lloyd et al. ..... 441/2
8,613,635 B2 * 12/2013 Fisher ..... 441/2
8,714,070 B2 * 5/2014 Martinez et al. ..... 89/1.34

* cited by examiner

*Primary Examiner* — Benjamin P Lee
(74) *Attorney, Agent, or Firm* — James T. Shepherd

(57) ABSTRACT

An improved cable cutting system for an exercise mine or other underwater payload is provided. The system utilizes a pro-pressurized gas cartridge as the source of compressed gas to operate a cable cutter and anti-scouring system. A firing pulse initiates a bottle-punch actuator positioned in a manifold. The actuator punctures the sealed nipple of the gas cartridge. The released gas is directed through the manifold and injected directly into a cylinder that drives a piston. The piston is connected to a chisel that is driven forward to cut the cable. The released gas can also activate the anti-scouring system or, alternatively, additional cartridges/punches may be used for the anti-scoring system.

8 Claims, 3 Drawing Sheets

CABLE CUTTING SYSTEM FOR RETRIEVAL OF EXERCISE MINES AND OTHER UNDERWATER PAYLOADS

STATEMENT OF GOVERNMENT INTEREST

The invention described herein may be manufactured and used by or for the Government of the United States of America for governmental purposes without the payment of any royalties.

BACKGROUND OF THE INVENTION (1) Field of the Invention

The present invention relates to cable cutting. More particularly, the present invention relates to remotely actuating a bottle punch to puncture a gas cylinder, wherein the released gas forces a cutter through a cable, thereby releasing a buoyant section of an exercise mine or other underwater payload from the sea floor so the payload can be retrieved at the surface.

(2) Description of the Prior Art

Current exercise mines use a ballast section for planting and recovery of the mines. These ballast section systems have not been updated for quite some time and are increasingly unreliable. The current system utilizes an air driven chisel or cutter system to cut a steel cable that mates a buoy section to the ballast section, thus allowing the buoy section to float to the surface for recovery.

Existing systems utilize a compressed air system to both drive the cutter and activate an anti-scouring system used to push the mine off the ocean bottom. Due to their age and complexity, these systems are difficult to maintain and support, and are increasingly unreliable. Additionally, these systems use an expensive, high-pressure 3-stage oil-free air compressor to generate the compressed air.

Thus, a need has been recognized in the state of the art to provide a more reliable, less costly and safer cable cutting system. Additionally, there is a need for a simpler system that would be easier to maintain and operate.

SUMMARY OF THE INVENTION

It is therefore a general purpose and primary object of the present invention to provide an improved cable cutting system for an exercise mine or other underwater payload. The new cable cutting system utilizes a pre-pressurized gas cartridge as the source of compressed gas to operate the cable cutter and the anti -scouring system.

A firing pulse initiates an explosive bottle-punch actuator positioned in a manifold. The actuator punctures the sealed nipple of the pre-pressurized gas cartridge. The released gas is directed through the manifold and injected directly into a cylinder that drives a piston. The piston is connected to a chisel that is driven forward to cut the cable.

The firing pulse also triggers additional bottle punch actuators to puncture additional cartridges. The released gas from these additional cartridges can activate the anti-scouring system. Alternatively, a single cartridge may be used to provide sufficient pressurized gas for both the cable cutting and anti-scouring systems.

In one embodiment, a cable cutting system for an exercise mine includes a pressurized gas cartridge, a nipple that seals an end of the cartridge and a punch disposed in proximity to the nipple. When activated, the punch is disposed through the nipple to release the gas in the cartridge. A piston is in fluid communication with the gas from the cartridge and moves a cutter to sever a cable that secures a buoy section of the mine to a ballast section. The system can include an actuator for activating the punch to release the gas. The actuator can be responsive to a recovery signal sent to the mine.

In one embodiment, the system can also include a manifold disposed between and in fluid communication with the cartridge and said piston. The manifold further can be in fluid communication with one or more ports that extend through an outer surface of said mine. Gas passing through the ports can assist in lifting the mine off the bottom. A check valve can be disposed is each port to prevent flow back into the manifold.

In one embodiment, the system can include one or more additional pressurized gas cartridges, with each cartridge having a nipple and punch arrangement described hereinabove. In lieu of connecting to the manifold, the gas from the additional cartridges can be directed directly through the aforementioned ports. Each additional cartridge can be paired with an actuator to activate the punch for the cartridge. Each actuator can be responsive to the recovery signal or to a separate signal.

In one embodiment, a recovery system for an exercise mine includes a cable connecting a ballast section of the mine to a buoy section of the mine, a pressurized gas cartridge disposed within the mine and a punch disposed in proximity to the cartridge. When activated, the punch is disposed through a seal of the cartridge to release the gas in the cartridge. A cutter is in fluid communication with the cartridge. The cutter is movable under pressure from the gas toward and through the cable to release the buoy section from the ballast section.

The system can include an actuator for activating the punch to release the gas. The actuator can be responsive to a recovery signal sent to the mine. The system can further include one or more ports in fluid communication with the cartridge and extending through an outer surface of the mine. Gas passing through the ports can assist in lifting the mine off the bottom. A check valve can be disposed in each port to prevent flow back into the mine.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DESCRIPTION OF THE INVENTION

Note that while the following description describes an exercise mine as an exemplary embodiment of the present invention, the present invention may also be used for other types of underwater payloads that are to be deployed/planted on a seafloor, such as an instrumented sensor package that collects environmental data and is then retrieved at the surface after a period of time.

Figure 1:
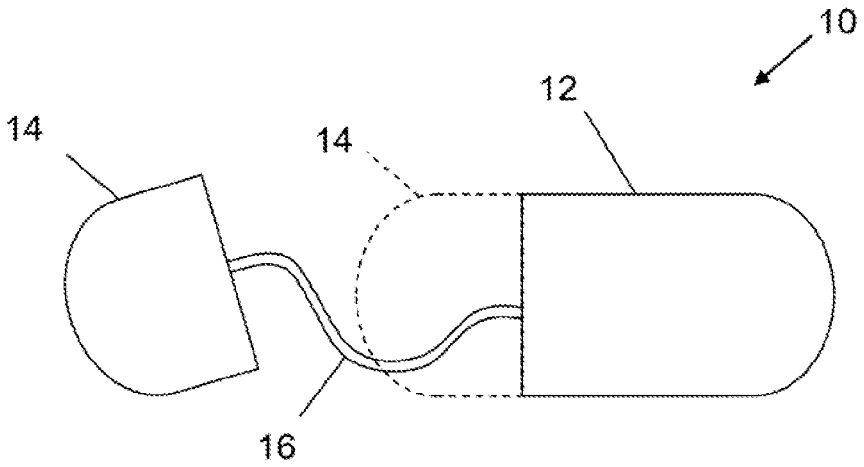
FIG. 1. illustrates an exercise mine in an unassembled configuration.

Referring now to FIG. 1, there is illustrated a schematic view of exercise mine 10 in an unassembled configuration.

Figure 2:
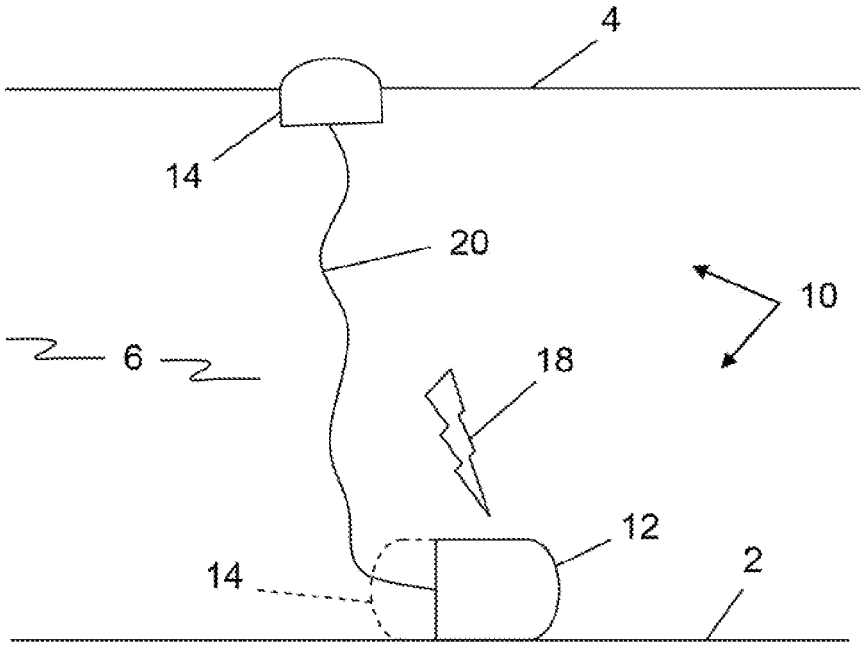
FIG. 2. illustrates the exercise mine of FIG. 1 in a recovery configuration.

Mine 10 includes ballast section 12 and buoy section 14. Ballast section 12 properly weights a mine 10 to achieve a proper orientation when mine 10 is planted, e.g., on a sea floor or bottom 2 (see. FIG. 2). Buoy section 14 is positively buoyant. Buoy section 14 is secured to ballast section 12 by cable 16. To assemble mine 10, cable 16 is tensioned so as to pull and seal buoy section 14 against ballast section 12, as illustrated in phantom in FIG. 1.

Referring now to FIG. 2, there is shown a schematic view of mine system 10 in a recovery configuration. To recover assembled mine 10 from its planted position (with buoy section 14 shown in phantom in FIG. 2) on bottom 2, recovery signal 18 is sent to mine 10 to cut cable 16. With cable 16 cut, buoy section 14 is free to separate from ballast section 12 and float to surface 4. As buoy section 14 rises through medium 6 to surface 4, recovery line 20 is paid out, such that ballast section 12 can also be recovered by using line 20 to raise it to surface 4.

Figure 3:
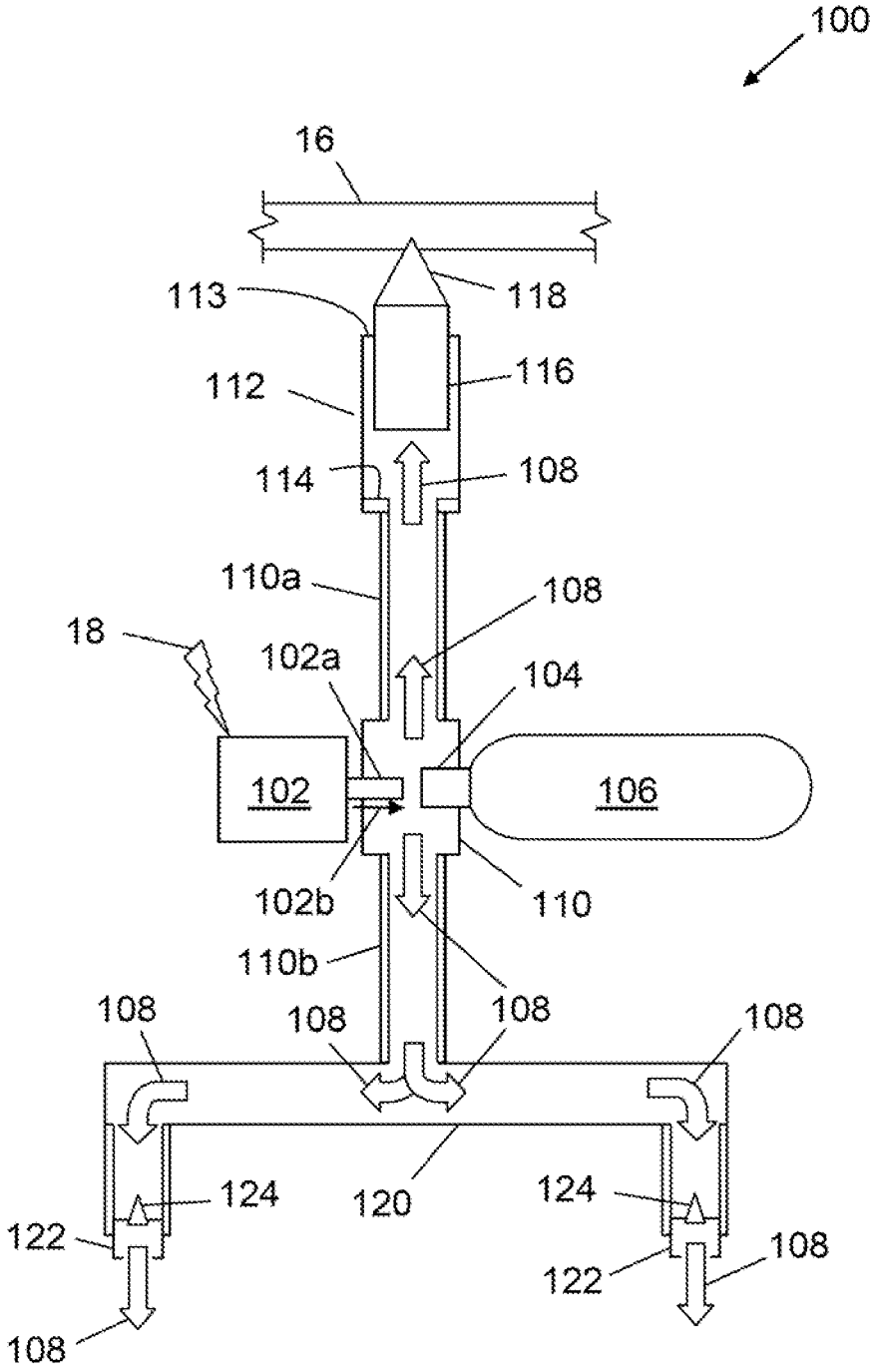
FIG. 3 illustrates a cable cutting system of the exercise mine of FIG. 1.

Referring now to FIG. 3, there is shown a schematic illustration of cable cutting system 100, which is disposed in the interior of exercise mine 10 in proximity to cable 16. Cable cutting system 100 is activated by recovery signal 18 so as to sever cable 16. Signal 18 activates bottle -punch actuator 102. Actuator 102 moves punch 102*a* in the direction of arrow 102*b* to puncture sealed nipple 104 of pre-pressurized gas cartridge 106. Pressurized gas within cartridge 106 is released (illustrated by arrows 108) and flows into manifold 110.

Cylinder 112 is connected to manifold 110 via cutter system manifold. piping 110*a* and cylinder port 114. Cylinder 112 has an open end 113 in close proximity to cable 16. Gas 108 flows from manifold 110, through cutter system piping 110*a* and port 114 and into cylinder 112. Piston 116 within cylinder 112 is pushed by gas 108 in the direction of flow of gas 108. Cable. cutter 118 is attached to piston 116 and is forced into contact with cable 16. As cable cutter 118 moves against cable 16, cable 16 is severed by cable cutter 118.

In addition to driving cutter 118 to sever cable 16, pressurized gas 108 can be directed through anti-scouring piping 110*b* to anti-scouring manifold 120. Anti-scouring manifold 120 directs pressurized gas 108 to one or more anti-scouring ports 122. As is known in the art, pressurized gas 108 flowing through ports 122 aids in pushing mine 10 off of bottom 2 (shown in FIG. 2). Ports 122 can include one-way valves 124 to prevent surrounding medium 6 (shown in FIG. 2) from entering manifold 120.

Figure 4:
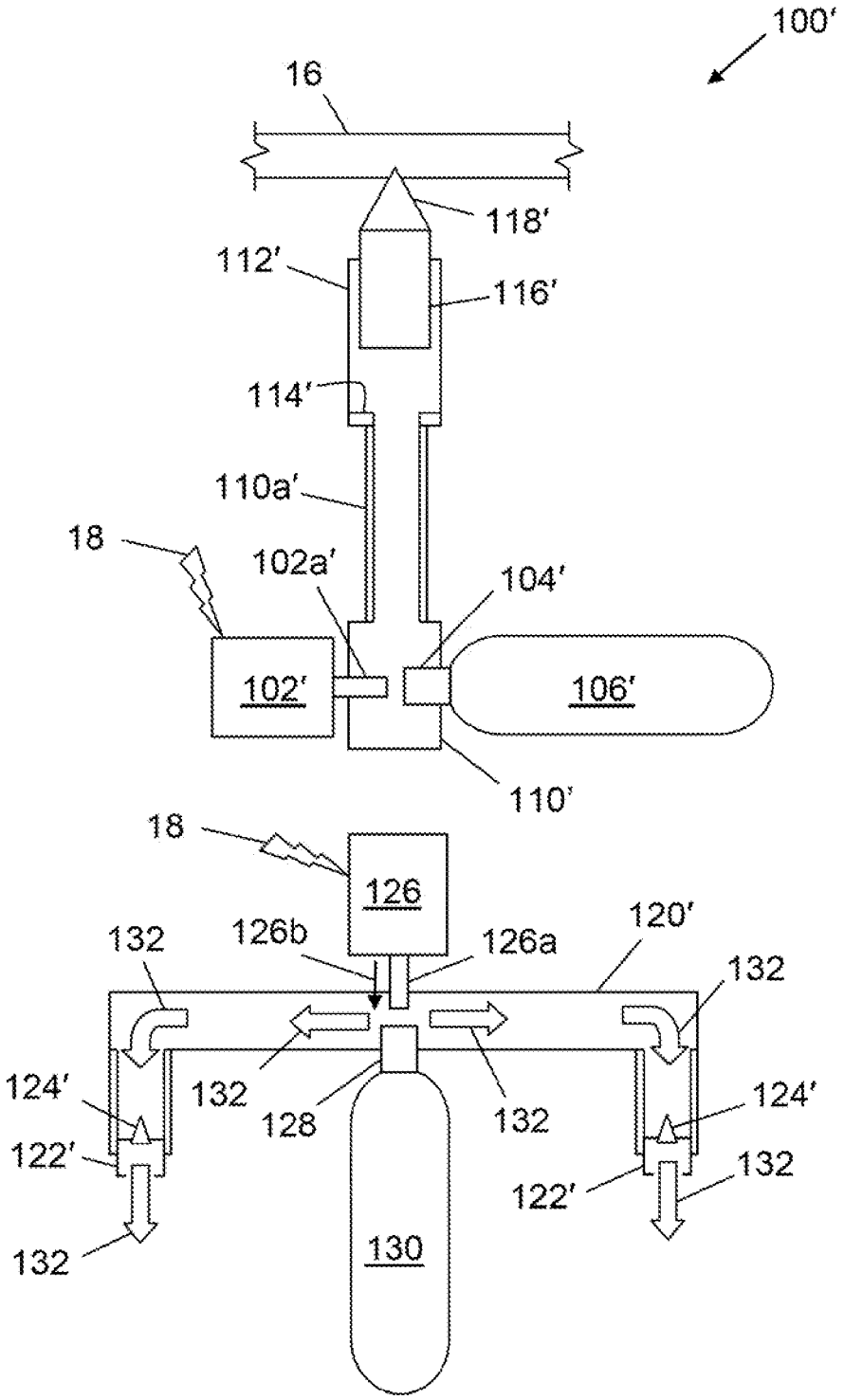
FIG. 4 illustrates an alternative cable cutting system of the exercise mine of FIG. 1.

Obviously many modifications and variations of the present invention may become apparent in light of the above teachings. Referring to FIG. 4, for example, there is shown a schematic illustration of alternate cable cutting system 100'. The functional aspects of actuator 102', punch 102*a'*, nipple 104', cartridge 106', piping 110*a'*, cylinder 112', cylinder port 114', piston 116' and cable cutter 118' remain essentially unchanged from system 100 of FIG. 3.

System 100' has two separate manifolds: Cutter manifold 110' and anti-scouring manifold 120'. In addition to activating actuator 102', recovery signal 18 also activates anti-scouring actuator 126. Similar to the action of punch actuator 102', anti-scouring actuator 126 moves anti-scouring punch 126*a* in the direction of arrow 126*b* to puncture sealed anti-scouring nipple 128 of pre-pressurized anti-scouring gas cartridge 130. Pressurized gas within cartridge 130 is released (illustrated by arrows 132) and flows into manifold. 120'.

Anti-scouring manifold 120' directs pressurized gas 132 to one or more anti-scouring ports 122'. As is known in the art, pressurized gas 132 flowing through ports 122' aids in pushing mine 10 off of bottom 2 (shown in FIG. 2). As with ports 122 of system 100 (FIG. 3), ports 122' can include one-way valves 124' to prevent surrounding medium 6 (shown in FIG. 2) from entering manifold 120'.

To minimize the buoyancy requirements for buoy section 14, pre-pressurized cartridges 106, 106' and 130 can be located within ballast section 12. However, one or more cartridges can be located within buoy section 14, provided that positive buoyancy of buoy section 14 is maintained.

Also, for system 100', separate signals may be used to activate actuator 102' and anti-scouring actuator 126. For example, recovery signal 18 may initiate the cutting of cable 16, such that buoy section 14 floats to the surface. Ballast section 12 may be lodged in bottom 2 so as to make recovery using line 20 difficult. A separate signal can then be sent to activate actuator 126 so as to free ballast section 12 from bottom 2 and allow recovery. Signals 18 are typically acoustic signal suitable for underwater communications; and actuators 102, 102', and 126 include acoustic receivers and electronics configured to respond to signals 18 (i.e., to activate punches 102*a*, 102*a'*, and 126*a*) as is known in the art.

What have thus been described are improved cable cutting and anti-scouring systems for a surface-retrievable, negatively buoyant, underwater payload such as an exercise mine. The new systems utilize pre-pressurized gas cartridges as the source of compressed gas to operate the cable, cutter and the anti-scouring system. A firing pulse initiates an explosive bottle-punch actuator positioned in a manifold. The actuator punctures the sealed nipple of the pre-pressurized gas cartridge. The released gas is directed through the manifold and injected directly into a cylinder that drives a piston. The piston is connected to a chisel that is driven forward to cut the cable.

The pressurized gas can also be directed to the anti-scouring system. Alternatively, the firing pulse can also trigger additional bottle punch actuators to puncture additional cartridges. The released gas from these additional cartridges can activate the anti-scouring system.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. A cable cutting system for a negatively buoyant underwater payload having a detachable buoyant section attached thereto by a cable, comprising:

a pressurized gas cartridge;

a nipple sealing an end of said cartridge;

a punch disposed in proximity to said nipple in a passive position, said punch disposed through said nipple in an activated position;

a piston in fluid communication with said cartridge when said punch is in said activated position, said piston movable under pressure from said gas;

a cable cutter attached to said piston, said cutter movable with said piston toward and through the cable when said punch is in said activated position;

an actuator having a passive configuration and an activated configuration, said passive position and said activated position of said punch corresponding respectively to said passive configuration and said activated configuration of said actuator;

a manifold disposed between and in fluid communication with said cartridge and said piston;

at least one port extending through an outer surface of the payload, said manifold further in fluid communication with said at least one port; and a check valve disposed at each said at least one port, said valve being closed to flow in a direction from the outer surface into said manifold.

2. The system of claim 1, wherein movement of said actuator from said passive configuration to said activated configuration is responsive to a recovery signal.

3. A negatively buoyant, retrievable underwater payload, comprising:

a negatively buoyant ballast section;

a positively buoyant buoy section coupled to said ballast section by a cable;

a cylinder having an open end in proximity to said cable;

a first manifold in fluid communication with said cylinder;

a first pressurized gas cartridge having a first sealed nipple in fluid communication with said manifold;

a first punch disposed in proximity to said first sealed nipple in a passive position, said punch disposed through said first sealed nipple in an activated position;

first actuator in communication with said first punch, said first actuator having a passive configuration and an activated configuration, said passive position and said activated position of said first punch corresponding respectively to said passive configuration and said activated configuration of said first actuator; and a piston movably within said cylinder, said piston Having a cutter coupled to an end thereof in proximity to said open end;

at least one port extending through an outer surface of said ballast section, said port in fluid communication with said first manifold; and a check valve disposed at each said at least one port, said valve being closed to flow in a direction from said outer surface into said port;

wherein said piston is movable in response to pressurized gas entering said cylinder when said first punch is in said activated position, said piston causing said cutter to move toward and through said cable; and wherein said first actuator is responsive to a recovery signal causing said first actuator to move from said passive configuration to said activated configuration.

4. The payload of claim , further comprising a recovery line coupled to said buoy section and said ballast section.

5. A negatively buoyant, retrievable underwater payload, comprising:

a negatively buoyant ballast section;

a positively buoyant buoy section coupled to said ballast section by a cable;

a cylinder having an open end in proximity to said cable;

a first manifold in fluid communication with said cylinder;

a first pressurized gas cartridge having a first sealed nipple in fluid communication with said manifold;

a first punch disposed in proximity to said first sealed nipple in a passive position, said punch disposed through said first sealed nipple in an activated position;

a first actuator in communication with said first punch, said first actuator having a passive configuration and an activated configuration, said passive position and said activated position of said first punch corresponding respectively to said passive configuration and said activated configuration of said first actuator;

a piston movably disposed within said cylinder, said piston having a cutter coupled to an end thereof in proximity to said open end;

at least one port extending through an outer surface of said ballast section;

a second manifold in fluid communication with each said at least one port;

a second pressurized gas cartridge having a second sealed nipple in fluid communication with said second manifold;

a second punch having a passive position and an active position, said second punch being disposed in proximity to said second sealed nipple when in said passive position, and said second punch being disposed through said second sealed nipple when in said activated position to thereby release pressurized gas from said second gas cartridge;

a second actuator in communication with said second punch, said second actuator having a passive configuration and an activated configuration, said passive position and said activated position of said second punch corresponding respectively to said passive configuration and said activated configuration of said second actuator; and a check valve disposed at each said at least one port, said valve being closed to flow in a direction from said outer surface into said port;

wherein said piston is movable in response to pressurized gas entering said cylinder when said first punch is in said activated position, said piston causing said cutter to move toward and through said cable.

6. The payload of claim 5, wherein each of said first actuator and said second actuator is selectively responsive to at least one recovery signal causing said actuator to move from its said passive configuration to its said activated configuration.

7. The payload of claim 6, wherein each said at least one recovery signal is an acoustic signal suitable for use in underwater communications.

8. The payload of claim 5, further comprising a recovery line coupled to said buoy section and said ballast section.

* * * * *